US011111686B2

(12) United States Patent
Pichon et al.

(10) Patent No.: US 11,111,686 B2
(45) Date of Patent: Sep. 7, 2021

(54) SWIMMING POOL CLEANING APPARATUS HAVING A DEBRIS SEPARATION DEVICE OPERATING BY CENTRIFUGAL SPINNING AND FILTRATION

(71) Applicant: ZODIAC POOL CARE EUROPE, Bron (FR)

(72) Inventors: Philippe Pichon, Villeneuve de Riviere (FR); Philippe Blanc Tailleur, Toulouse (FR); E. Keith McQueen, Vista, CA (US)

(73) Assignee: ZODIAC POOL CARE EUROPE, Belberaud (FR)

( * ) Notice: Subject to any disclaimer, the term of this patent is extended or adjusted under 35 U.S.C. 154(b) by 0 days.

(21) Appl. No.: 16/648,005

(22) PCT Filed: Sep. 24, 2018

(86) PCT No.: PCT/EP2018/075795
§ 371 (c)(1),
(2) Date: Mar. 17, 2020

(87) PCT Pub. No.: WO2019/057968
PCT Pub. Date: Mar. 28, 2019

(65) Prior Publication Data

US 2020/0270891 A1 Aug. 27, 2020

Related U.S. Application Data

(60) Provisional application No. 62/561,841, filed on Sep. 22, 2017.

(30) Foreign Application Priority Data

Dec. 22, 2017 (FR) ..... 1762981

(51) Int. Cl.
*E04H 4/16* (2006.01)
*E04H 4/12* (2006.01)

(52) U.S. Cl.
CPC ..... *E04H 4/1654* (2013.01); *E04H 4/1245* (2013.01)

(58) Field of Classification Search
CPC ..... E04H 4/1654; E04H 4/1245
(Continued)

(56) References Cited

U.S. PATENT DOCUMENTS 9,896,858 B1 * 2/2018 Hayes ..... E04H 4/1654
2016/0215516 A1 7/2016 Hayes et al.

FOREIGN PATENT DOCUMENTS

EP 2725169 4/2014
EP 2848751 3/2015
(Continued)

OTHER PUBLICATIONS

French Application No. 1762981, Search Report dated Aug. 22, 2018, 8 pages.

(Continued)

*Primary Examiner* — Fred Prince
(74) *Attorney, Agent, or Firm* — Kilpatrick Townsend & Stockton LLP; Dean W. Russell

(57) ABSTRACT

The invention relates to a device (18) for separating out debris suspended in a liquid, for a swimming pool cleaning apparatus, said cleaning apparatus comprising: —a body (11), —at least one hydraulic circuit circulating liquid between at least one liquid inlet (15) and at least one liquid outlet (16), and through the separation housing (18) that separates out debris suspended in the liquid, —a fluid circulation pump installed in the hydraulic circuit. The device (18) for separating out debris suspended in a liquid comprises means for the centrifugal spinning of the debris
(Continued)

Figure 1:
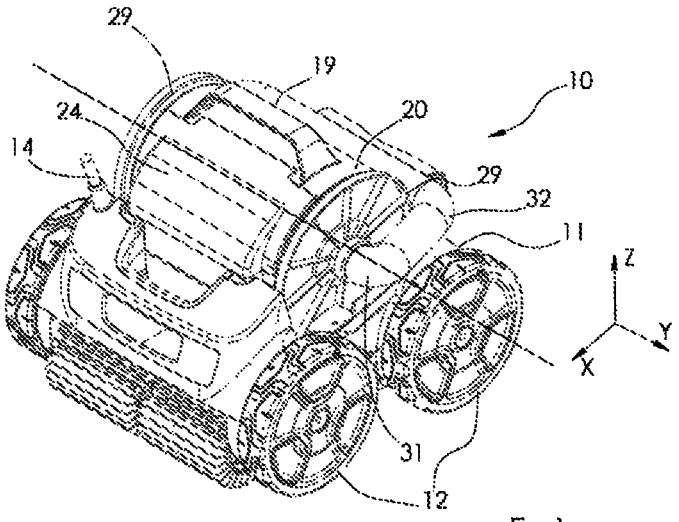

suspended in the liquid and a tank for collecting said centrifugally separated debris. The separation device (18) comprises a liquid supply duct (24) opening into a filtration chamber (22) defining a substantially cylindrical volume, tangentially to a cylindrical wall (201) of said filtration chamber, said filtration chamber (22) communicating with the collecting tank (23) that collects the centrifugally separated debris.

18 Claims, 6 Drawing Sheets

(58) Field of Classification Search
USPC ..... 210/167.16, 167.17, 416.2; 15/1.7
See application file for complete search history.

(56) References Cited

FOREIGN PATENT DOCUMENTS

| | | |
|---|---|---|
| EP | 3205793 | 8/2017 |
| FR | 2989596 | 10/2013 |
| WO | 2014097304 | 6/2014 |
| WO | 2015059424 | 4/2015 |
| WO | 2016123098 | 8/2016 |
| WO | 2016181065 | 11/2016 |

OTHER PUBLICATIONS

International Application No. PCT/EP2018/075795, International Preliminary Report on Patentability dated Mar. 24, 2020, 14 pages.
International Application No. PCT/EP2018/075795, International Search Report and Written Opinion dated Jan. 7, 2019, 12 pages.
Dolphin S Series Robots, Maytronics, Dolphin, Available Online At: http://www.robot-dolphin.fr/piscines-residentielles/gamme-s-series/, Accessed from Internet on May 1, 2020, 5 pages.
Fully Automatic Pool Robots from Mariner 3S, Mariner 3S, Available Online: https://www.mariner-3s.com/fr/telechargement/produits/compact-600.html, Accessed from Internet on May 1, 2020, 3 pages.
Hayward Residential and Commercial Pool Products, Hayward, Available Online At: https://www.hayward-pool.com/shop/TopCategoriesDisplay?storeId=10201&urlLangId=-1&urlReguestType=Base&langId=-1&catalogId=10551, Accessed from Internet on May 1, 2020, 5 pages.
Robotic Pool Cleaner for Large Commercial Pools: Dolphin Wave 200 XL, Maytronics, Dolphin, Available Online At: http://dolphinpoolrobot.com/fr/commercial-pool-cleaners/pro-line/pro-wave-200, Accessed from Internet on May 1, 2020, 10 pages.

* cited by examiner

SWIMMING POOL CLEANING APPARATUS HAVING A DEBRIS SEPARATION DEVICE OPERATING BY CENTRIFUGAL SPINNING AND FILTRATION

CROSS-REFERENCE TO RELATED APPLICATIONS

This application is a national stage entry of International Application No. PCT/EP2018/075795, filed on Sep. 24, 2018, which claims priority to French Application No. 1762981, filed on Dec. 22, 2017 and U.S. Provisional Application No. 62/561,841, filed on Sep. 22, 2017, all of which are incorporated herein by reference in their entireties.

The present invention relates to the field of equipment for swimming pools.

It more particularly relates to an autonomous swimming pool cleaning apparatus of the robot type that comprises a water circuit to be cleaned and at least one means for filtering debris present in suspension in the water.

PREAMBLE AND PRIOR ART

The invention relates to a surface cleaning apparatus immersed in a liquid, such as the surface formed by the walls of a basin, in particular of a swimming pool. More specifically, the invention refers to a mobile swimming pool cleaning robot. Such a cleaning robot performs said cleaning by passing along and brushing the walls of the swimming pool, and by aspirating any debris towards a filter suitable for collecting said debris. "Debris" here means all of the particles present within the basin and that have a surface or volume measurement comprised within a predetermined interval of which the limits are according to the technical characteristics of the robot, in such a way that, on the one hand, the lower limit authorises the entry of said particles into the filtration device, and, on the other hand, the upper limit prevents said particles form exiting the filtration device. Such debris can include for example pieces of leaves, microalgae, etc., with this debris being in particular deposited at the bottom of the basin or stuck on the lateral walls of the latter.

Most often, the robot is supplied with energy by an electrical cable that connects the robot to an external control and power unit.

Currently, there are different immersed surface cleaning apparatuses, in particular with a removable filtering device. Such apparatuses comprise a body, members for driving said body on the immersed surface, a filtration chamber arranged within the body and including a liquid inlet, a liquid outlet, a hydraulic circuit circulating liquid between the inlet and the outlet through a filtering device. Furthermore, in these so-called cleaning apparatuses, the filtering device can be detached and extracted from the body of the apparatus without having to turn over the cleaning apparatus. Such cleaning apparatuses are described in particular in documents WO 2016/181065 and FR 2 989 596 of the applicant.

These apparatuses have automatic programs for cleaning the bottom of the basin and optionally the lateral walls of the basin. Such a program determines a cleaning of the swimming pool in a predetermined time. Generally, the robot is removed from the water by the user at the end of the cycle or at regular intervals, when the filter can no longer ensure its functions due to an overflow of particles (leaves, microparticles etc.), and requires cleaning. In certain recent models, the external control and power unit of the robot emits a lighted signal when this filter cleaning operation has to be carried out.

The action of cleaning the filter by the user imposes upon the latter to take the robot out of the swimming pool in order to extract the filter housed within the body thereof, then to empty the filter and finally to wash it with plenty of water, for example using a watering hose. These operations are potentially messy for the user in that the risk of contact with the debris and filtration sludge is not negligible. These cleaning operations therefore constituent for the user a source of inconvenience.

The invention has for purpose to overcome in particular this disadvantage.

Disclosure of the Invention

The invention relates in a first aspect to a device, or housing, for separating debris in suspension in a liquid, for a swimming pool cleaning apparatus, said swimming pool cleaning apparatus comprising:

- a body,
- at least one hydraulic circuit circulating liquid between at least one liquid inlet and at least one liquid outlet, and through the device for separating out debris suspended in the liquid,
- at least one fluid circulation pump installed in the hydraulic circuit.

The device for separating debris in suspension in a liquid includes:

- means for the centrifugal spinning of the debris suspended in the liquid and means for collecting this centrifuged debris.

"Swimming pool cleaning apparatus" means an apparatus for cleaning an immersed surface, i.e. typically a mobile apparatus within or at the bottom of a swimming pool basin, and suitable for carrying the filtration of debris deposited on the bottom as well as on a wall. Such an apparatus is commonly known under the name of swimming pool cleaning robot, when it includes automated means of managing the displacements at the bottom and on the walls of the swimming pool in order to cover the entire surface to be cleaned.

"Liquid" here refers to the mixture of water and of debris, or particles, in suspension in the swimming pool or in the fluid circulation circuit within the cleaning apparatus.

"Debris separation" designates any form of segregating debris in suspension in order to produce at the outlet of the separation device a liquid that is free from its debris. The segregating means can in particular include means of centrifugation or of filtration.

The means of centrifugation advantageously allow for a mechanical separation of the particles, via centrifugal force.

Preferably, the separation device includes a supply, or intake, duct of the liquid opening according to a tangential direction in a debris separation chamber, or filtration chamber, defining a substantially cylindrical volume, said filtration chamber communicating with the collecting tank that collects the centrifugally separated debris.

In other terms, the liquid supply duct opens tangentially into a cylindrical wall of the filtration chamber.

The liquid supply duct is configured, in shape and in size, in such a way as to drive a substantial speed of the liquid loaded with debris.

According to particular embodiments, the invention furthermore meets the following features, implemented separately or in each one of the technically permissible combinations thereof.

In an embodiment, the filtration chamber and the collecting tank that collects the centrifugally separated debris communicate by an opening present in the cylindrical wall of the filtration chamber. The opening is preferably disposed in the lower portion of the cylindrical volume of the filtration chamber, when the separation device is in place in the body of the robot.

In other terms, the collecting tank that collects the centrifugally separated debris forms a radial protuberance external to the cylindrical volume defined by the filtration chamber, from the cylindrical wall. The collecting tank that collects the centrifugally separated debris extends radially outwards from the filtration chamber, from the cylindrical wall. The axis of the filtration chamber is preferably parallel to a horizontal plane XY of the cleaning apparatus.

The collecting tank that collects the centrifugally separated debris is in the lower portion of the separation device when said separation device is inserted into the body of the robot.

With such a separation device, the debris of which the size and the density are substantial with respect to the liquid are centrifuged and pushed against the peripheral wall of the filtration chamber by continuing their circular movement induced by the movement of the liquid then are expulsed towards the collecting tank when they arrive in the proximity thereof.

In a particular embodiment that allows for a very good separation of the debris in the liquid, the separation device also includes a filtration device.

In an embodiment, the filtration device is arranged at the centre of the filtration chamber. Thus, the lightest and smallest debris, which are not centrifuged, are filtered.

In this case, in a more particular embodiment, the filtration device includes a tangential filtration device.

In an embodiment, the filtration device includes a front filtration device.

More particularly in this case, the front filtration device is inserted into the tangential filtration device detachably, which allows for easy cleaning and a very compact device.

In a particular embodiment, the separation device is such that the filtration device can be removed from said debris separation device. This also favours easy cleaning of the swimming pool cleaning apparatus.

In this case, in a more particular embodiment, the separation device includes two lateral faces, with one of the faces forming a cover and being hermetically mounted, detachably, on the filtration chamber.

In a particular embodiment, the filtration device forms a mainly cylindrical volume mounted coaxially in the central portion of the filtration chamber, and configured to separate the internal volume of said chamber from at least one orifice of filtered liquid outlet.

In a particular embodiment, the separation device includes, between the filtration chamber and the collecting tank that collects the centrifugally separated debris, a deflector formed by a portion of the cylindrical wall of the filtration chamber that is extended above the collecting tank that collects the centrifugally separated debris.

In a particular embodiment, the separation device includes, between the filtration chamber and the collecting tank that collects debris, a deflector forming wall with convex continuity with the cylindrical wall of the chamber.

A deflector creates a zone in which the speed of the liquid is low with regards to its speed in the filtration chamber by centrifugation. Because of this, the debris is naturally deposited in said collecting tank and remains there. In addition, this deflector makes it possible to homogenise the peripheral speed in the filtration chamber and thus improve the centrifugation of the debris. It also makes it possible to generate an inverse circulation in the trap zone thus preventing the debris from returning to the filtration chamber.

More particularly, the deflector determines an angular opening (a) of about 60° from the filtration chamber to the collecting tank.

The invention relates in a second aspect to a swimming pool cleaning apparatus including a separation device such as disclosed hereinabove, the separation device being detachably mounted in the swimming pool cleaning apparatus.

More particularly in this case, the axis of the cylindrical filtration chamber is parallel to a horizontal plane XY of the apparatus.

Alternatively, the axis of the cylindrical filtration chamber is parallel to a transversal axis Y of the apparatus.

The invention also relates to a modification kit for a swimming pool cleaning apparatus, said kit including a separation device such as disclosed, and means for adapting this separation device on the body of the swimming pool cleaning apparatus.

The invention also relates to an immersed surface cleaning apparatus that is characterised by all or a portion of the characteristics mentioned hereinabove or hereinafter.

PRESENTATION OF THE FIGURES

The characteristics and advantages of the invention shall be better appreciated thanks to the following description, description that discloses the features of the invention through a non-limiting application example.

Figure 2:
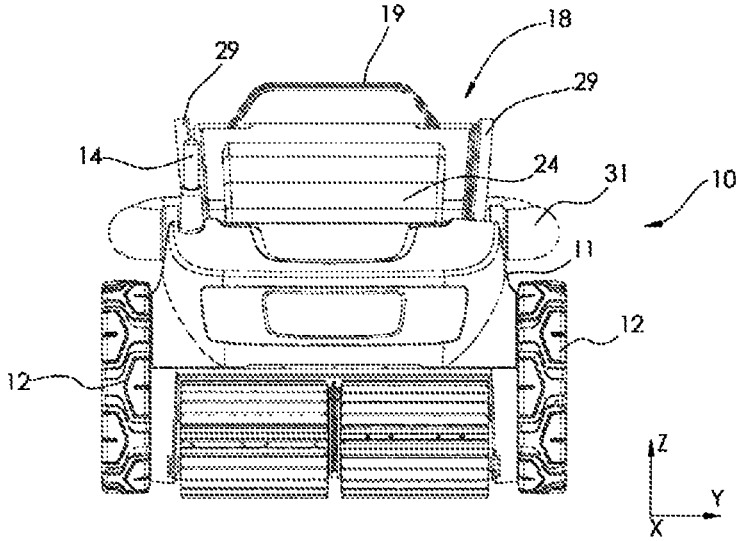
Figure 3:
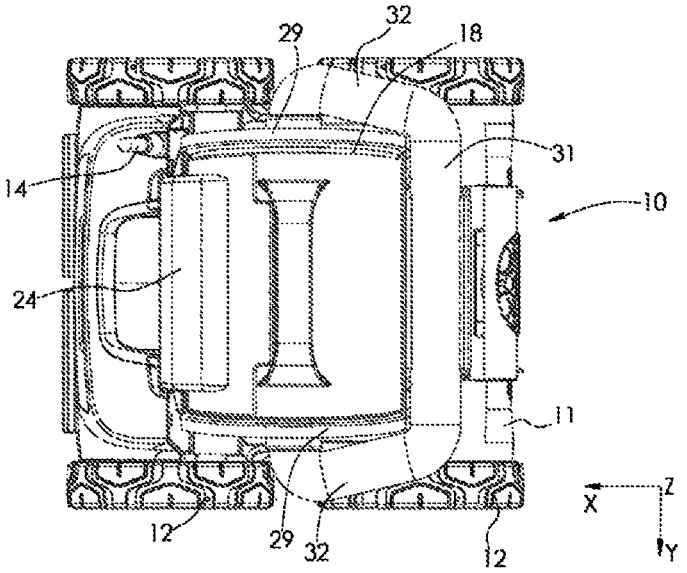
Figure 4:
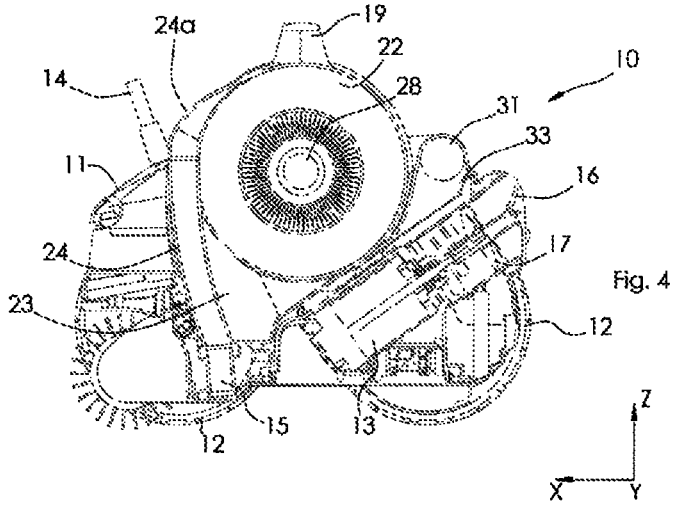
Figure 5:
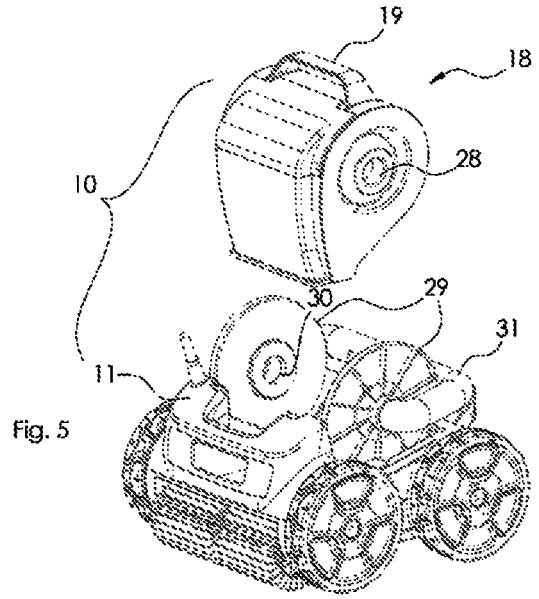
Figure 6:
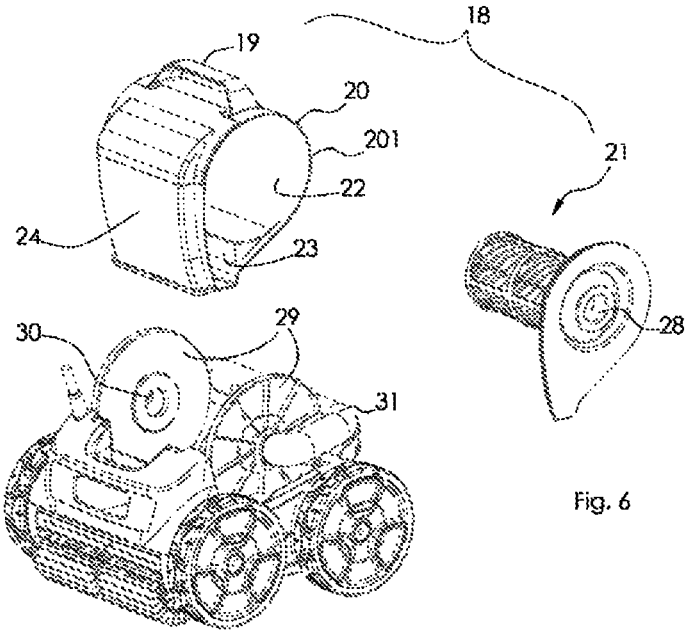
Figure 7:
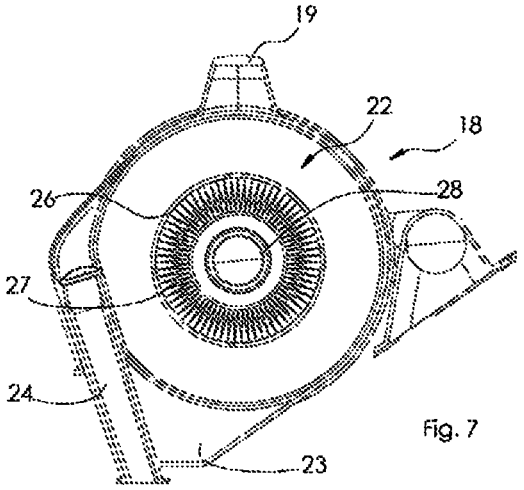
Figure 8:
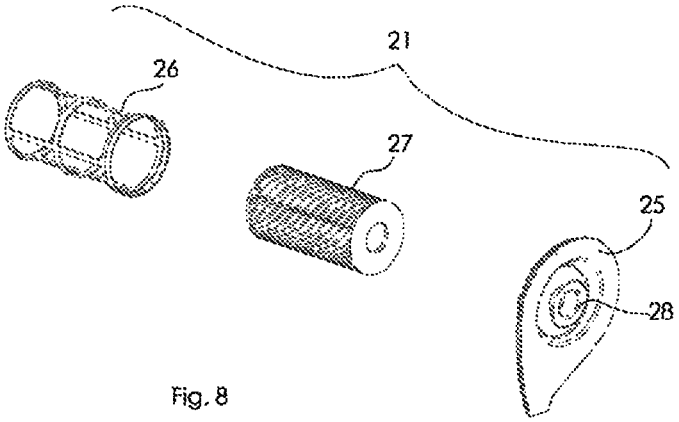
Figure 9:
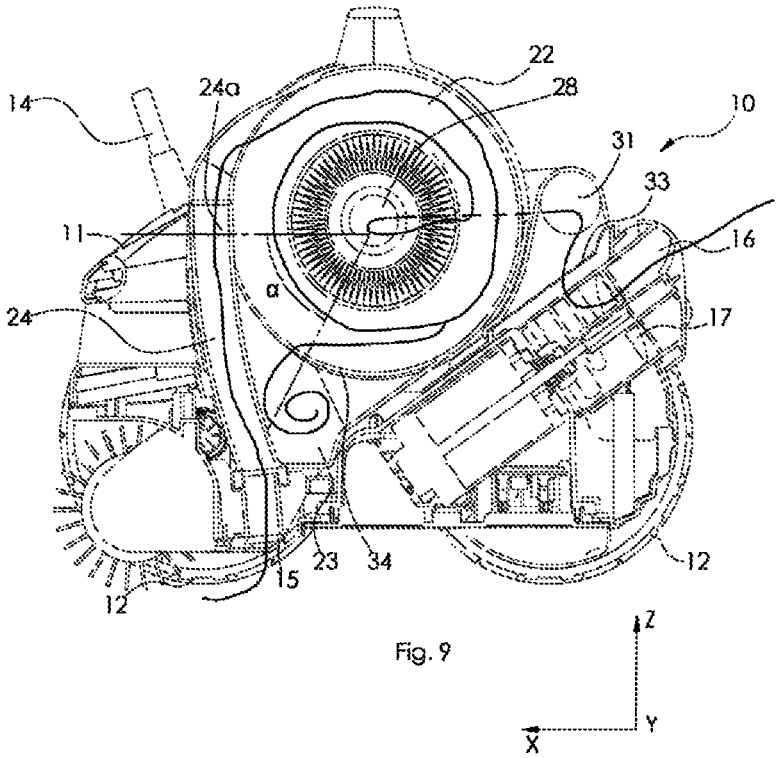
Figure 10:
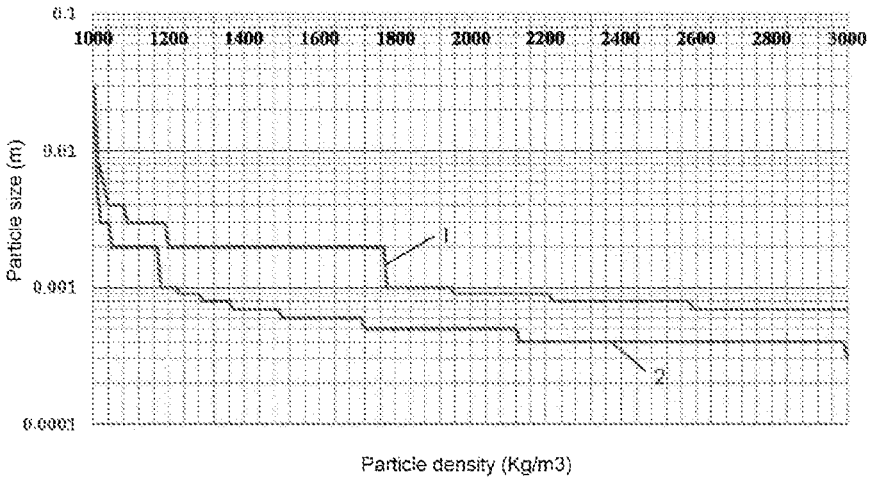

The description makes use of the accompanying figures wherein:

FIG. 1 shows a perspective view of a swimming pool cleaning apparatus implementing a debris separation device such as disclosed, FIG. 2 shows a front view of the same apparatus, FIG. 3 shows a top view of the same apparatus, FIG. 4 is a cross-section view of the cleaning apparatus, according to a longitudinal vertical plane, FIG. 5 shows the removal of the filter unit from said separation housing, FIG. 6 shows the removal of the separation housing extracted from the body of the apparatus, FIG. 7 is a cross-section view of the cleaning apparatus, along a longitudinal vertical plane, FIG. 8 shows in more detail the elements that form the filter unit, FIG. 9 shows the current lines within the cleaning apparatus, when the latter is operating in a swimming pool, FIG. 10 shows two delimitation curves between the particles that will be centrifuged and those that will not be, obtained for two examples of cleaning apparatuses.

DETAILED DESCRIPTION OF AN EMBODIMENT OF THE INVENTION

The invention has its place in a swimming pool technical environment, for example an in-ground pool of the family type.

An immersed surface cleaning system includes, in the present embodiment, a cleaning apparatus 10, referred to hereinafter as swimming pool cleaning robot, and a unit for powering and controlling said swimming pool cleaning robot (not shown in the figures). In an alternative, this power and control unit can be integrated into the cleaning apparatus.

The swimming pool cleaning robot 10 is shown according to an embodiment given here by way of example, in FIGS. 1, 2 and 3. In these figures, the type of swimming pool cleaning robot 10 is here with an ejection of water tilted towards the rear of the cleaning apparatus, relatively to the running surface of the swimming pool cleaning robot.

The swimming pool cleaning robot 10 comprises a body 11 and members for driving and guiding 12 the body 11 on an immersed surface. In the present example, these members for driving and guiding 12 are formed from wheels disposed laterally to the body 11 (see in particular FIG. 1).

The members for driving and guiding define a guide plane XY on an immersed surface by their points of contact with said immersed surface. Said guide plane is generally substantially tangent to the immersed surface at the point at which the swimming pool cleaning robot is located. Said guide plane XY is for example substantially horizontal when the swimming pool cleaning robot is moving on an immersed surface of the bottom of the swimming pool.

Throughout the text, the notions "top" and "bottom" are defined along a straight line Z, perpendicular to said guide plane XY, with a "bottom" element being closer to the guide plane than a top element. By language abuse, the guide plane is said to be horizontal, and the direction perpendicular to this surface is said to be vertical. The axis of displacement of the robot is said to be the longitudinal axis X, and the axis perpendicular to this direction in the guide plane is said to be the transversal axis Y.

As can be seen better in FIG. 4, the swimming pool cleaning robot 10 further comprises a motor 13 that drives said members for driving and guiding 12, said motor 13 being, in the present example, supplied with energy by the control unit via a sealed flexible cable 14, of which a portion can be seen in FIGS. 1 to 4, at the point of insertion of this cable 14 in the body 11 of the swimming pool cleaning robot 10.

Still in reference to FIG. 4, the swimming pool cleaning robot 10 has at least one liquid inlet 15 and a liquid outlet 16. The liquid inlet 15 is located at the base of the body 11 (in other terms under the latter according to the vertical axis Z), i.e. immediately facing an immersed surface on which the swimming pool cleaning robot 10 moves so as to be able to aspirate the debris accumulated on said immersed surface. As can be seen in FIG. 1 in particular, the swimming pool cleaning robot 10 usually comprises a brush, for example with multiple concentric strips, intended to detach the particles, or debris, deposited on the walls of the swimming pool.

The liquid outlet 16 is here located at the rear and in the top portion of the swimming pool cleaning robot 10 according to the longitudinal direction X. In the present example, the liquid outlet 16 is carried out in a direction oriented towards the rear of the apparatus. This disposition is not however limiting, and a water outlet that is substantially perpendicular to the guide plane XY, i.e. oriented vertically (direction Z) if the swimming pool cleaning robot 10 rests on the bottom of swimming pool, can also be considered.

The apparatus comprises a hydraulic circuit that connects the liquid inlet 15 to the liquid outlet 16. The hydraulic circuit is adapted to be able to provide a circulation of liquid from the liquid inlet 15 to the liquid outlet 16. The apparatus comprises for this purpose a circulation pump that comprises the motor 13 of the electrical type already mentioned, and a propeller 17 (see FIG. 4), said motor 13 driving the propeller 17 in rotation, said propeller 17 being disposed in the hydraulic circuit.

The apparatus comprises a device for separating out debris suspended in a liquid, called in what follows separation housing 18. The separation housing 18 disposed, on the hydraulic circuit, downstream from the liquid inlet 15. This separation housing 18 is advantageously, but not necessarily, of the type that can be extracted from the body 11 of the swimming pool cleaning robot 10. This arrangement is shown in FIG. 5.

As can be seen in FIGS. 1 to 4, the separation housing 18 first comprises a substantially cylindrical volume of which the internal portion forms a filtration chamber 22. When the separation housing 18 is inserted into the body 11 of the robot 10, the axis of this cylindrical volume is, in the present non-limiting embodiment, parallel to the transversal axis Y of the swimming pool cleaning robot 10. The separation housing 18 is supplemented in the lower portion by a storage tank 23, or collecting tank, of debris, said tank 23 being in continuity of the cylindrical volume in the lower portion of the latter. In other terms, the collecting tank that collects the debris is not contained in the cylindrical volume. The collecting tank that collects the debris communicates with the cylindrical volume.

The separation housing 18 is supplemented in the front portion by a liquid supply, or intake, duct 24 in said cylindrical filtration chamber 22, with this liquid supply duct 24 being connected to the liquid inlet 15.

As can be seen in FIG. 6, the separation housing 18 is removed in the form, on the one hand, of a housing body 20, and, on the other hand, of a filter unit 21. In the embodiment described here as a non-limiting example, the housing body 20 includes in its upper portion a gripping handle 19, here carried out as a single piece with said housing body 20, and suitable for allowing for the extraction of the separation housing 18 from the body 11 of the swimming pool cleaning robot 10. Alternatively, the handle 19 is mobile with respect to the housing body 20.

Still in reference to FIG. 6, it is observed that the substantially cylindrical volume that forms the filtration chamber 22 is comprised of a cylindrical wall 201 (here with an axis parallel to the transversal axis Y when the separation housing 18 is mounted on the body 11 of the robot 10), and of two lateral faces (perpendicular to this transversal axis Y), with the cylindrical wall 201 and a first lateral face, referred to as the outer lateral face, of the cylindrical volume forming the filtration chamber 22 being comprised in the housing body 20, while the second lateral face, referred to as inner lateral face, is comprised in the filter unit 21. Once the filter unit 21 is hermetically assembled on the housing body 20, a cylindrical volume for the filtration chamber 22 is thus effectively determined.

The cylindrical wall 201 has two openings:

- one opening to allow the liquid to enter the filtration chamber,
- one opening to allow for the passage of the debris to the debris collecting tank.

The liquid supply duct 24 and the filtration chamber 22 form in part the means of centrifugation of debris. The liquid supply duct 24 has in the horizontal plane XY a substantially rectangular extended section. In the present embodiment, due to the form of the body 11 of the robot, the water supply duct, that connects the liquid inlet 15 to the filtration chamber 22 in the front portion of the latter, has in the vertical plane XZ a slightly curved profile that ends in the top portion 24*a* of said liquid supply duct 24 by a direction of the flow of water that is substantially vertical. The liquid supply duct 24 is thus disposed in its upper portion 24*a* tangentially to the cylindrical wall 201 of the filtration chamber 22. The liquid supply duct 24 then merges with the filtration chamber 22, of which the cylindrical wall has at this location an opening, referred to as a mouth, that allows the entry of the liquid almost tangentially to the cylindrical wall 201 in its inner face. In this way, the flow of liquid in the filtration chamber 22 is tangential to the wall, which gives the liquid a movement of rotation within said filtration chamber 22, with the speed of this flow being determined by various parameters such as the power of the fluid circulation pump, the section of the liquid inlet and the load losses in the liquid circuit. A centrifugation effect of a predetermined intensity is thus generated for the densest particles, present in the liquid and therefore driven in a circular movement in the cylindrical volume of the filtration chamber 22. The centrifuged particles are recovered in the debris collecting tank.

The centrifugation effect is also obtained from a geometry adapted to the liquid supply duct 24 and the filtration chamber 22, and from a suitable dimension of the mouth.

Those skilled in the art are able, in light of their knowledge, to define the particular conditions and geometries to allow for a centrifugation of the debris in suspension in a liquid.

The debris collecting tank 23, disposed under the filtration chamber 22, has in the longitudinal vertical plane XZ a section formed at the front portion by the curved wall of the liquid supply duct 24, at the rear portion by a flat surface, here disposed tangentially to the cylindrical wall 201 of the housing body 20. These two walls are in the present example disposed in planes that are practically perpendicular.

In the upper portion thereof, this section of the collecting tank 23 is therefore open onto the filtration chamber 22 over a maximum of one quarter of the circumference of said cylindrical filtration chamber 22. The precise angle $\alpha$ (FIG. 9) of the angular opening from the cylindrical chamber to the collecting tank 23 is determined by the choice of the length of a portion of the cylindrical wall of the filtration chamber 22 that is extended above the collecting tank 23 and thus forming a deflector 34 that constrains the circulation of the liquid. In the present embodiment, the angular opening a from the cylindrical filtration chamber 22 to the collecting tank that collects debris 23 is about 60° of the circumference of said cylindrical filtration chamber 22. Lower or higher values of this opening angle $\alpha$ can however be considered.

The effect of the deflector 34 is to create in the collecting tank a zone with a near-zero speed of the liquid, which allows the centrifugally separated debris in the cylindrical filtration chamber 22 to be deposited in the collecting tank 23 and to remain there without again being driven in the flow by the rapid movement of the liquid in the filtration chamber 22.

The filter unit 21 can be removed from the housing body 20, in order to allow the user to clean the inside of the housing body 20 and the filter unit 21. In the closed position, the filter unit 21 is hermetically assembled on the housing body 20.

The means for hermetically fastening the filter unit 21 onto the housing body 20 are of the type known to those skilled in the art and as such leave the scope of the present invention. The same applies to the means for fastening the separation housing 18 on the body 11 of the swimming pool cleaning robot 10.

The filter unit 21 comprises a support plate 25, forming the second lateral face of the filtration chamber 22 mentioned hereinabove, and two coaxial filters 26, 27. The external filter 26 is of the mesh filter type supported by a support structure, here figured by three circles connected by four spacers. This filter is made from a material that is suitable for retaining particles of dimensions greater than 300 microns. This value is provided as an indication; it can vary between 200 and 700 μm. This filter makes it possible to collect the large non-centrifuged particles (pieces of leaves or grass). This filter can be used alone outside of the period of use of the swimming pool in order to remove large debris such as leaves.

The internal filter 27 is of the accordion filter cartridge type. It is suitable for retaining particles in suspension in the liquid that have dimensions greater than 50 microns. The folds make it possible to significantly increase the filtering surface and thus limit the clogging of this filter.

The diameter of the internal filter 27 is suitable for being inserted into the external filter 26 with a clearance less than a few millimetres. For each one of these two filters 26, 27, the entry of the water to be filtered is done through the portion outside the filter and the exiting of the filtered water through the portion inside said filter. In this way, the exiting of the water that has passed through the two coaxial filters 26, 27 is done via the axial zone of the filter unit 21.

To this effect, the support plate 25 has in its central portion an axial opening 28, intended to face the axial zone of the filters 26, 27, when the latter are assembled in the separation housing 18 and to allow for the exiting of filtered water outside the separation housing by this second lateral end wall. The diameter of this axial opening is substantially identical to the inner diameter of the filter cartridge 27, in such a way as to limit the load losses in the hydraulic circuit. Likewise, symmetrically with respect to the longitudinal vertical plane XZ, the housing body 20 has an axial opening (28 on in FIGS. 4, 7 and 9) in the central portion of the first end wall of the cylindrical volume, in such a way as to arrange another filtered liquid outlet at the other end of the coaxial filters 26, 27, when the latter are assembled in the separation housing 18.

It is understood that the two coaxial filters 26, 27 are tight between, on one side, with the lateral face of the body of the housing 20 forming the first lateral face of the separation housing 18 and, on another side, the support plate 25 forming the second lateral face of the separation housing 18, when the filter unit 21 is mounted in the body of the housing 20 in order to form the separation housing 18. This assembly of the two coaxial filters 26, 27 on the lateral faces of the separation housing 18 is hermetic in order to prevent as much as possible the passing of unfiltered water to the water circulation pump.

In the present embodiment, the body of the housing 20 and the support plate 25 are made from a plastic material or other suitable material, by techniques known to those skilled in the art, for example moulding, gluing etc.

As can be seen in particular in FIGS. 5 and 6 which show a non-limiting embodiment, the separation housing 18 is inserted, when it is assembled on the body 11 of the swimming pool cleaning robot 10, between two flat walls 29 in the form of discs (with only one of these flat walls able to be seen in FIGS. 5 and 6). These flat walls 29 here protect the lateral faces of the body of the housing 20 and allow for better guiding during the placing of the separation housing 18.

Moreover, these flat walls 29 include points for fastening 31 (see FIG. 1) on the frame of the body 11 which determine the positioning of the separation housing 18 with regards to the body 11 of the robot 10 and allow in particular for the positioning of the water supply duct 24 above the water inlet 15 (see FIGS. 4 and 8) in order to ensure a continuity of the liquid flow.

It is understood that it is then possible to design different sets of flat walls 29 according to various robot models, while still retaining a single model of separation housing 18, in such a way as to make it possible to adapt afterwards such a new separation housing 18 on a pre-existing robot, by removing the pre-existing filtering portion of the frame of a swimming pool cleaning robot 10, then by fastening therein suitable lateral walls 29 of which the geometry will have been adapted to this purpose. It is thus possible to define a set of adaptation kits for the new separation housing 18 on a certain number of prior models, for example, in the case of the geometry of the separation housing 18 described here in a non-limiting way, of robot models that have a water inlet 15 extending laterally, and a water outlet 16 disposed in the rear portion of the body 11 of the robot, with the original filter being removed via the top of the robot. This arrangement provides greater flexibility of use for the separation housing, and makes it possible to improve the filtration performance of pre-existing robots.

Each one of these flat walls 29 includes at its centre an opening 30 (see FIG. 5) intended for the passage of filtered water, said opening 30 facing the corresponding axial opening 28 of the body of the housing 20 when the latter is assembled on the body 11 of the robot 10. Likewise, each one of the flat walls 29 includes a seal that can provide the tightness of the filtered water circuit, when the robot 10 is being used. These seals are made from a material and have a geometry that are known per se to those skilled in the art.

As can be seen in particular in FIGS. 1 to 3, 5 and 6, the robot 10 includes a filtered water collector tube 31. This filtered water collector tube 31 with a substantially "U" shape, is disposed in the rear portion of the body 11 of the robot, and includes two lateral arms 32, each one of these arms 32 being connected to a lateral wall 29 at the axial opening 30.

The two lateral arms 32 come together above a water intake zone 33 of the propeller 17 of the fluid circulation pump. In this way, the water collected at the outlet of the two lateral faces of the separation housing 18, through the lateral walls 29, is returned to the circulation pump and is removed at the rear of the swimming pool cleaning robot 10.

As was mentioned hereinabove, in the case of the adaptation of the new separation housing to a pre-existing robot, the filtered water collector tube 31 has a geometry such that the water outlet of the tube is located facing the water inlet of the liquid circulation pump. In this case of an adaptation of a separation housing 18 to a pre-existing robot, the lateral walls 29 and the filtered water collector tube 31 are therefore specific to the model of robot 10, while the separation housing 18 is unchanged for a set of robots.

Operating Mode

In the present embodiment, when the robot is put into operation, a rapid circular movement of the liquid to be filtered occurs within the cylindrical filtration chamber 22 around the axis of the latter. As was seen hereinabove, the heaviest particles are centrifuged and are progressively deposited in the collecting tank 23.

On the other hand, the other particles, in suspension in the liquid, continue to rotate in the cylindrical chamber and are progressively aspirated towards the filter unit by the effect of the depression created by the liquid circulation pump. The largest particles (diameter greater than 300 microns) are retained by the external filter 26, that they constantly sweep tangentially under the effect of the circulation of fluid in the filtration chamber 22. This external filter is similar to a tangential filtration device. They also contribute to constantly unclogging this external filter 26. The smallest particles (dimensions less than 300 microns) pass through the external filter 26, and the flow of liquid is then substantially frontal at the outlet of the external filter 26 and at the entry of the internal filter 27 with a filter cartridge, which forms conditions that are favourable for the use of this type of filter. This internal filter 27 is similar to a front filtration device. As the internal filter 27 becomes clogged, the aspiration pressure decreases in the liquid circuit, at an unchanged pumping power, and the circulation speed decreases in the filtration chamber 22, which decreases the sweeping effect of the external filter by the large particles and therefore increases the clogging of this external filter. During all this time, the largest debris remain in the collecting tank that collects debris 23, of which the inner liquid speed is very low with regards to the speed in the filtration chamber 22.

Beyond a predetermined pressure drop threshold in the fluid circuit, an alert signal is sent to the user of the swimming pool cleaning robot 10, who then takes the latter out of the swimming pool, extracts the separation housing 18, opens it in order to extract the filter unit therefrom, removes the external filter 26 and the internal filter 27, and cleans them with plenty of water, as well as the collecting tank 23. The filtration output is clearly improved through the use of centrifugation and segregation of centrifugally separated debris in conjunction with a filtration device with two levels, tangential and frontal, which reduces the number of filter cleanings to be performed by the user for the same total quantity of debris extracted from the liquid.

Simulations, using CFD (Computational Fluid Dynamic) modelling software, have been conducted in order to determine whether or not a particle will be centrifuged. By configuring the density and the size of the particle, movement quantity equations of the particle are resolved (with the forces taken into account being the weight, the buoyancy, the drag and the added mass force).

By analysing the trajectory of the particle, it is possible to determine if the latter will come into contact with the external filter 26, and therefore will pass through it or will be thrust against it, or if the latter will be centrifuged and remain in rotation and/or will become trapped in the collecting tank.

FIG. 10 shows two curves obtained for two cleaning apparatuses which are differentiated solely at the dimension of the mouth. Each curve is a delimitation curve between the particles that will be centrifuged and those that will not be, according to the density and the size (diameter) of the particles.

Curve 1 was obtained for a cleaning apparatus with a rectangular-shaped mouth of height 38 mm, inducing a speed of the fluid of about 0.75 m $s^{-1}$ in the filtration chamber 22 for a liquid flow rate of 15 $m^3$ $h^{-1}$.

Curve 2 was obtained for a cleaning apparatus with a rectangular-shaped mouth of height 20 mm, inducing a speed of the fluid of about 1.15 m $s^{-1}$ in the filtration chamber 22 for a liquid flow rate of 15 $m^3$ $h^{-1}$.

For each cleaning apparatus and associated curve, the particles located in the zone under the curve cannot be centrifuged. Those in the zone above the curve can be centrifuged. It is observed that with the cleaning apparatus that has the mouth with the smallest dimension, more particles are centrifuged.

Alternatives

In an alternative non-limiting embodiment, a liquid check valve of the type known per se is disposed in the upper portion of the water supply duct 24.

In another alternative embodiment, the axis of the cylindrical filtration chamber is not parallel to the transversal axis Y, but takes another orientation, parallel to the horizontal plane XY or not. The disposition in which the cylindrical chamber has an axis parallel to the transversal axis Y of the robot is however advantageous in that it minimises the gyroscope effects during the turning of the robot in the basin.

In another alternative embodiment, each outlet 28 is put into relation with an independent collector tube 31 which conveys the clean water to a water intake zone 33 of each propeller 17 of fluid circulation. Each propeller 17 is driven by an independent pump motor 13 and pushes the water to an independent outlet located at the rear of the swimming pool cleaning robot 10.

The invention claimed is:

1. Device for separating out debris suspended in a liquid, for a swimming pool cleaning apparatus, said cleaning apparatus comprising:

a body, at least one hydraulic circuit circulating liquid between at least one liquid inlet and at least one liquid outlet, and through the device for separating out debris suspended in the liquid, at least one fluid circulation pump installed in the hydraulic circuit, the device for separating out debris suspended in a liquid including means for the centrifugal spinning of the debris suspended in the liquid and a non-cylindrical tank for collecting said centrifugally separated debris, wherein the separation device includes a liquid supply duct opening into a filtration chamber defining a substantially cylindrical volume, tangentially to a cylindrical wall of said filtration chamber, said filtration chamber communicating with the collecting tank that collects the centrifugally separated debris.

2. Separation device according to claim 1, wherein the filtration chamber and the collecting tank that collects the centrifugally separated debris communicate by an opening present in the cylindrical wall of the filtration chamber.

3. Separation device according to claim 1, wherein said device also includes a filtration device.

4. Separation device according to claim 3, wherein the filtration device includes a tangential filtration device.

5. Separation device according to claim 3, wherein the filtration device includes a front filtration device.

6. Separation device according to claim 5, wherein the front filtration device is inserted into the tangential filtration device detachably.

7. Separation device according to claim 3, wherein the filtration device can be detached from said debris separation device.

8. Separation device according to claim 1, wherein said device includes two lateral faces, with one of the faces forming a cover and being hermetically mounted, detachably, on the filtration chamber.

9. Separation device according to claim 1, wherein the filtration device forms a mainly cylindrical volume mounted coaxially in the central portion of the filtration chamber, and configured to separate the internal volume of said chamber from at least one orifice of filtered liquid outlet.

10. Separation device according to claim 1, wherein said device includes, between the debris separation chamber and the collecting tank that collects the centrifugally separated debris, a deflector formed by a portion of the cylindrical wall of the filtration chamber that is extended above the collecting tank that collects the centrifugally separated debris.

11. Swimming pool cleaning apparatus including a separation device according to claim 1, the separation device being detachably mounted in the swimming pool cleaning apparatus.

12. Swimming pool cleaning apparatus according to claim 11, wherein an axis of the cylindrical filtration chamber is parallel to a horizontal plane of the apparatus.

13. Swimming pool cleaning apparatus according to claim 12, wherein the liquid supply duct opens into the filtration chamber above the axis.

14. Swimming pool cleaning apparatus according to claim 11, wherein an axis of the cylindrical filtration chamber is parallel to a transversal axis of the apparatus.

15. Swimming pool cleaning apparatus according to claim 14, wherein the liquid supply duct opens into the filtration chamber above the axis of the cylindrical filtration chamber.

16. Device for separating out debris suspended in a liquid, for a swimming pool cleaning apparatus, said cleaning apparatus comprising:

a body, at least one hydraulic circuit circulating liquid between at least one liquid inlet and at least one liquid outlet, and through the device for separating out debris suspended in the liquid, at least one fluid circulation pump installed in the hydraulic circuit, the device for separating out debris suspended in a liquid including means for the centrifugal spinning of the debris suspended in the liquid and a tank for collecting said centrifugally separated debris, wherein the separation device includes (i) a liquid supply duct opening into a filtration chamber defining a substantially cylindrical volume, tangentially to a cylindrical wall of said filtration chamber, said filtration chamber communicating with the collecting tank that collects the centrifugally separated debris, and (ii) a deflector formed by a portion of the cylindrical wall that is extended above the collecting tank, and wherein the deflector determines an angular opening of about 60° from the filtration chamber to the collecting tank.

17. Modification kit for a swimming pool cleaning apparatus comprising a body, at least one hydraulic circuit circulating liquid between at least one liquid inlet and at least one liquid outlet, and through a device for separating out debris suspended in the liquid, and at least one fluid circulation pump installed in the hydraulic circuit, said kit including the separation device comprising means for the centrifugal spinning of the debris suspended in the liquid, a tank for collecting said centrifugally separated debris, a liquid supply duct opening into a filtration chamber defining a substantially cylindrical volume, tangentially to a cylindrical wall of said filtration chamber, said filtration chamber communicating with the collecting tank that collects the centrifugally separated debris, and means for adapting this separation device on the body of the swimming pool cleaning apparatus.

18. Swimming pool cleaning apparatus comprising:

a. a body having an inlet and an outlet;

b. members for driving and guiding the body on an immersed surface of a swimming pool;

c. a pump configured to draw water through the inlet; and d. a debris separation device positioned in a flow path between the inlet and the outlet and comprising (i) a filtration chamber having a cylindrical wall and defining a longitudinal axis, (ii) a liquid supply duct having a lower portion extending from the inlet and an upper portion opening into the filtration chamber tangentially to the cylindrical wall above the longitudinal axis, and (iii) a tank for collecting debris separated from water in the flow path.

* * * * *